US006758286B2

(12) United States Patent
Walker

(10) Patent No.: US 6,758,286 B2
(45) Date of Patent: Jul. 6, 2004

(54) MOTORGRADER CIRCLE DRIVE

(75) Inventor: Rob Walker, Strathroy (CA)

(73) Assignee: Volvo Motor Graders Limited, Goderich (CA)

( * ) Notice: Subject to any disclaimer, the term of this patent is extended or adjusted under 35 U.S.C. 154(b) by 0 days.

(21) Appl. No.: 10/368,041

(22) Filed: Feb. 19, 2003

(65) Prior Publication Data

US 2004/0000413 A1 Jan. 1, 2004

(30) Foreign Application Priority Data

Jun. 26, 2002 (CA) ..... 2391675

(51) Int. Cl.[7] ..... E02F 3/76
(52) U.S. Cl. ..... 172/795; 172/791
(58) Field of Search ..... 172/297, 300, 172/301, 304, 305, 3, 7, 10, 2, 795, 781, 791, 792, 796

(56) References Cited

U.S. PATENT DOCUMENTS 3,512,589 A * 5/1970 Ulrich ..... 172/786
3,976,146 A * 8/1976 Desourdy ..... 172/788
3,983,945 A * 10/1976 Hart et al. ..... 172/795
4,161,987 A * 7/1979 Tolmer ..... 172/791
4,304,307 A * 12/1981 Anderson ..... 172/791
5,584,346 A * 12/1996 Sakamoto et al. ..... 172/4.5
5,720,353 A * 2/1998 Wilkening ..... 172/795
5,782,016 A * 7/1998 Feller et al. ..... 37/384
5,813,150 A * 9/1998 Feller et al. ..... 37/234
6,028,524 A * 2/2000 Hartman et al. ..... 340/686.6
6,129,156 A * 10/2000 Boast et al. ..... 172/4.5
6,152,238 A * 11/2000 Ferrell et al. ..... 172/2
6,278,955 B1 * 8/2001 Hartman et al. ..... 702/105

FOREIGN PATENT DOCUMENTS

CA 2196728 8/1998

* cited by examiner

*Primary Examiner*—Victor Batson
(74) *Attorney, Agent, or Firm*—Blake, Cassels & Graydon LLP

(57) ABSTRACT

A circle drawbar assembly uses a series of hydraulic cylinders disposed within the circle member and attached to the drawbar frame to rotate the circle member. These cylinders can also be used to lock the circle member in a desired position. The cylinders preferably are secured to the drawbar frame at a position close to but offset from the axis of rotation of the circle member. The cylinders rotate with rotation of the circle member.

19 Claims, 6 Drawing Sheets

SECTION A-A

MOTORGRADER CIRCLE DRIVE

BACKGROUND OF THE INVENTION

The present invention relates to circle drawbar assemblies of the type used in motorgraders.

Motorgraders have a drawbar assembly attached near the nose of the grader and the drawbar assembly is pulled by the grader as it moves forward. The drawbar rotatably supports a circle member at a free end of the drawbar and the circle member supports a work implement. The angle of the work implement beneath the drawbar is changed by rotation of the circle member relative to the drawbar. In addition, hydraulic cylinders attached to the grader frame are used to position the circle drawbar assembly beneath the grader frame.

Traditionally, circle members are supported by a series of bearings attached to the drawbar and the circle member includes a series of gear teeth disposed to the exterior circle member or disposed to the interior of the circle member. These gear teeth cooperate with one or more drive gears associated with drive motors attached to the drawbar. Other arrangements have used pinion gears which mesh with the large ring gear. In one design, hydraulic cylinders are used in association with a crank arm for rotating of the pinion gears.

The manufacture of the large ring gear is time consuming and expensive. Some designs have been directed to more effective ways for manufacture of this gear component by breaking the ring gear into smaller segments attached to the rotatable circle. This design has some advantages and disadvantages, however, it is still time consuming and expensive to manufacture.

A motorgrader has high loads exerted on the work implement typically a grader blade secured beneath the grader. The ring gear and pinion gears or the drive motors are subject to high loads as these components are used to lock the circle member in the set position. In addition to the high load environment, the very nature of a motorgrader exposes these components to abrasive contaminants. Work hardening of the components and other heat treatment techniques are used, however, the components are subject to wear. Unfortunately, in many applications it is highly desirable to closely control the position of the grader blade which is difficult when wear is present.

There remains a need for an efficient manner of controlling the locking and movement of a circle member in a circle drawbar assembly.

SUMMARY OF THE PRESENT INVENTION

A circle drawbar assembly for use in a motorgrader, according to the present invention comprises a drawbar frame, a circle member mounted on the drawbar frame for rotation about a circle axis, a work implement mounted below the circle member and rotatable therewith, a drive arrangement secured to the frame and connected to the circle member for rotation thereof about the circle axis. The drive arrangement comprises a plurality of hydraulic cylinders connected to the circle member at space positions and each hydraulic cylinder is pivotally connected to the frame at a position adjacent to but offset from the circle axis. A control arrangement is used for controlling the extension and retraction of the cylinders in timed relationship to rotate the circle member about the circle axis.

According to an aspect of the invention the control arrangement is a hydraulic timing valve.

According to yet another aspect of the invention the timing valve includes an input signal corresponding to the rotary position of the circle member.

In yet a further aspect of the invention the timing valve includes a mechanical input signal associated with the rotary position on the circle member relative to the drawbar frame, and the mechanical input signal is used to control the hydraulic cylinders.

In a further aspect of the invention the plurality of hydraulic cylinders are at least three hydraulic cylinders.

In a further aspect of the invention the drive arrangement can be used to effect rotation of the circle member through an angle of at least 270 degrees.

In yet a further aspect of the invention the cylinders are attached to the circle member to define a similar angular spacing between adjacent cylinders.

In a further aspect of the invention the drawbar member has at least three bearings secured thereto which engage an inwardly directed flange of the circle member.

In a further aspect of the invention the hydraulic cylinders function to maintain the position on the circle member when the cylinders are not used to rotate the circle member.

In a further aspect of the invention the circle member includes at an outer edge thereof, a downwardly extending circle flange connected to said inwardly extending flange and being concentric therewith.

BRIEF DESCRIPTION OF THE DRAWINGS

The above as well as other advantages and features of the present invention will be described in greater detail according to the preferred embodiments of the present invention in which.

DETAILED DESCRIPTION TO THE PREFERRED EMBODIMENTS

Figure 1:
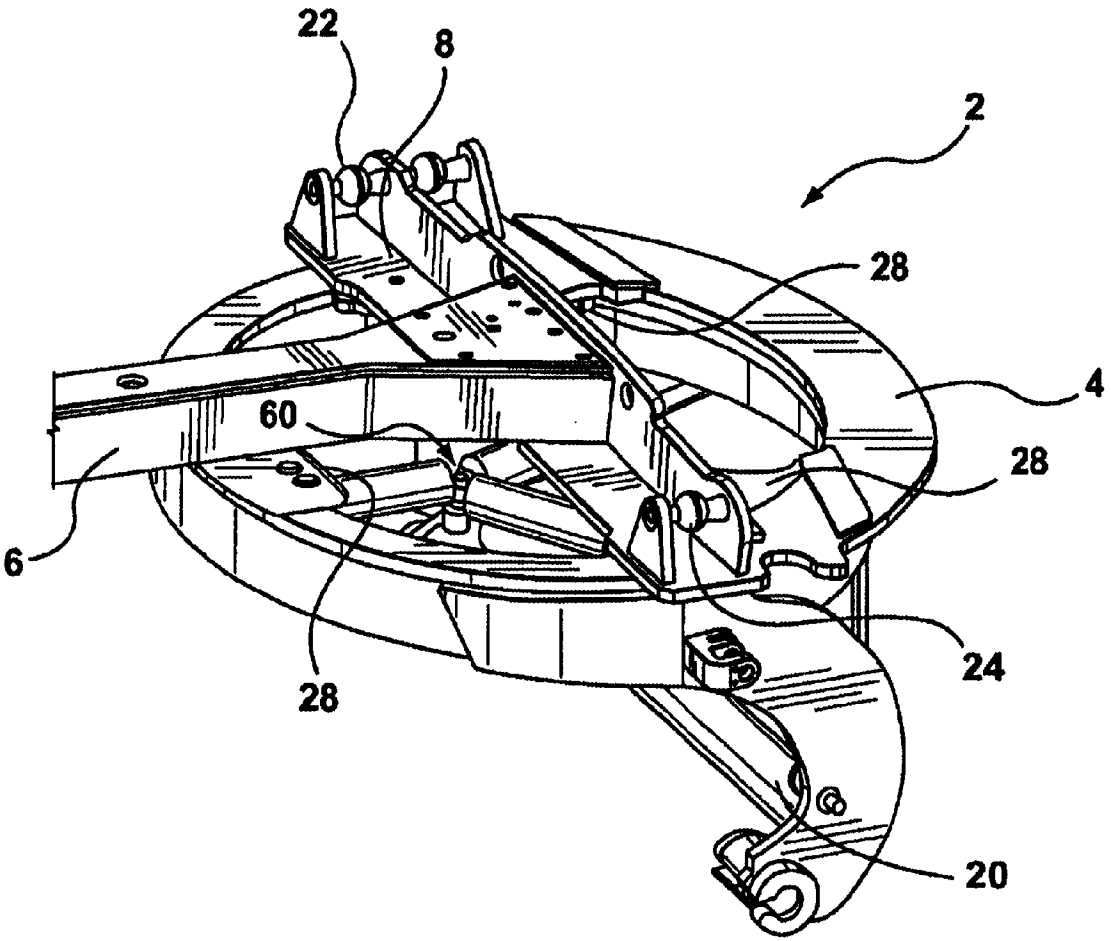
FIG. 1 is partial perspective view of a circle drawbar assembly.

The perspective view of the circle drawbar assembly 2 shown in FIG. 1 has a rotatable circle member 4 pivotally secured beneath the drawbar 6. The free end of the drawbar includes a cross member 8 to form a T-shape. Bearings 28 engage the circle member 4 at a series of points spaced about the circle member and rotatably support the circle member 4 beneath the drawbar 6. The circle member 4 rotates about the center point of the circle member.

Three hydraulic cylinders 36, 38 and 40 are located within the circle member and are pivotally secured to the drawbar 6. This pivot securement can be more fully appreciated from the bottom view of FIG. 2. Each of the hydraulic cylinders 36, 38 and 40 are rotatable about the securing shaft 42. This securing shaft is located on the center axis of the drawbar 6 and is preferably located forward of the center axis of the circle which is identified as 30. In this way the shaft 42 is forwardly offset of the circle axis 30 about which the circle rotates. With this arrangement the angle of the hydraulic cylinders 36, 38 and 40 changes with the position of the circle 4 beneath the drawbar 6 and in most cases the cylinders will not be on a radial axis of the circle. Extension or retraction of the hydraulic cylinders in timed relationship to each other circle member in a clockwise or counter clockwise direction. Each of the hydraulic cylinders is pivotally secured to the circle member 4 at positions 44, 46 and 48 respectively. These positions are spaced about the circle member in a manner such that two of the cylinders are more effective when one of the cylinders becomes significantly less effective (i.e., closer to radial alignment).

Figure 3:
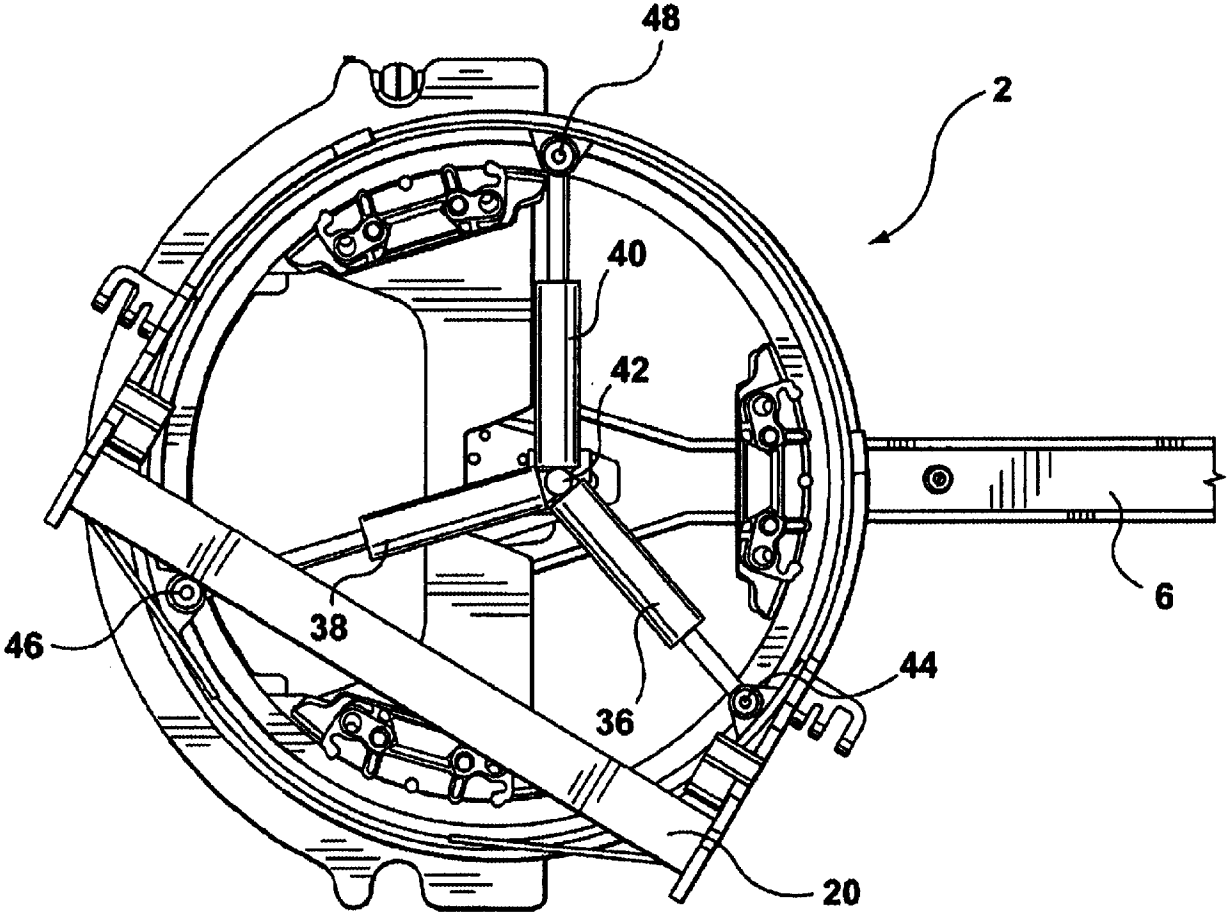
FIG. 3 is a bottom view of the circle drawbar assembly with the circle member rotated in a counter clockwise direction from the neutral position.
Figure 4:
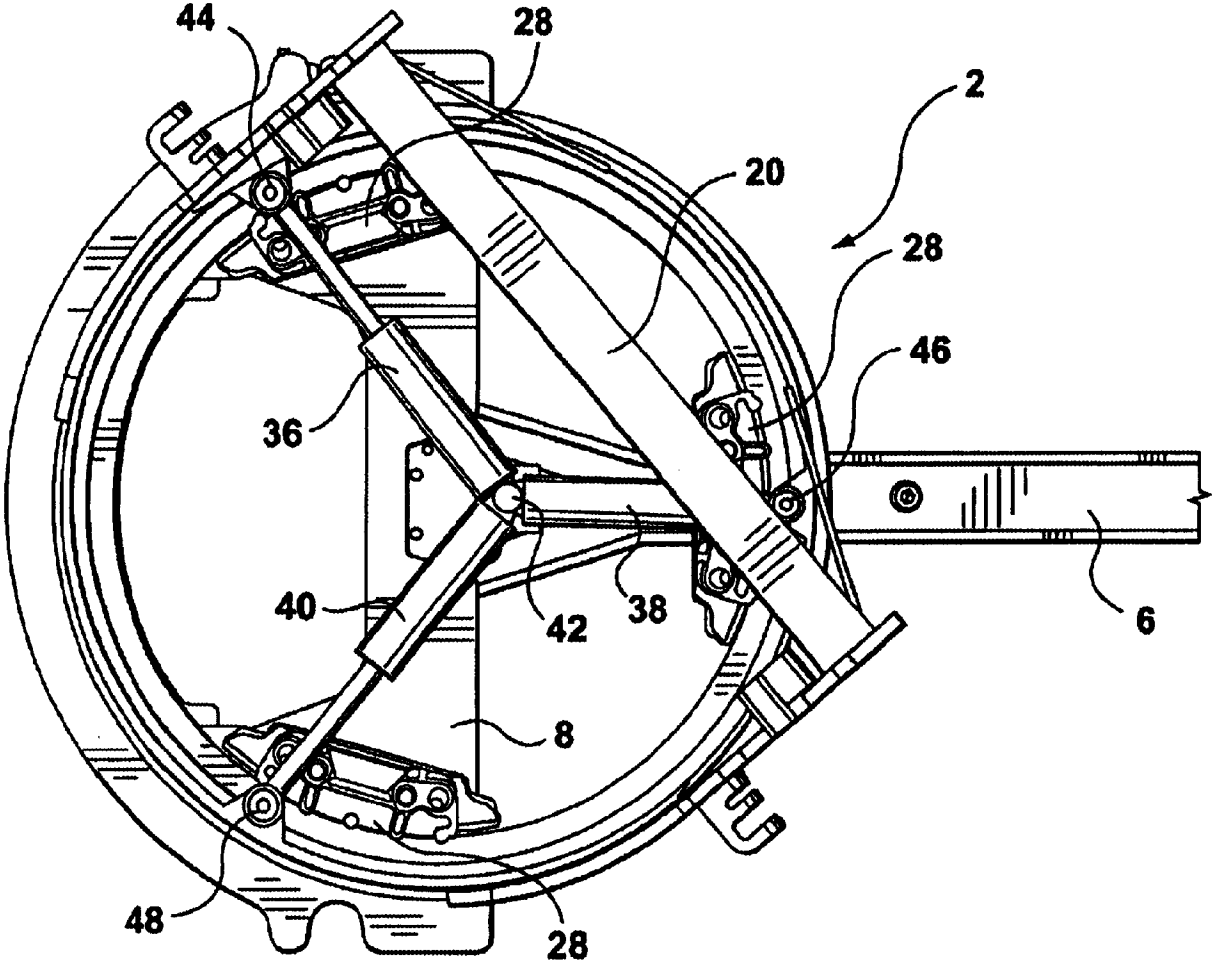
FIG. 4 is a bottom view of the circle drawbar assembly with the circle member rotated to yet a further position.

FIGS. 3 and 4 show the cylinders in different positions and the circle member has been rotated beneath the drawbar 6. A timing arrangement 60 is preferably a hydraulic timing valve and is used to control the supply and return of hydraulic fluid to the hydraulic cylinders. These hydraulic cylinders preferably are two-way cylinders.

The arrangement shows the hydraulic cylinders as all being secured about the common shaft 42. Other arrangements are possible however the common shaft with all cylinders being pivotally secured thereto overcomes interference between the cylinders. The position of the shaft 42 has been located to render the cylinders more effective for the most common positions of the grader blade beneath the drawbar 6.

Once a grader blade has been attached to the circle member 4, the position of the grader blade relative to the frame of the grader only requires a maximum angle of rotation of the circle member beneath the drawbar of about 270 degrees. Unless the drawbar and circle member have been moved to the outside of the grader frame and angled upwardly, the grader blade would strike parts of the motorgrader if further rotation were attempted. It can be appreciated that the circle member is fully rotatable beneath the drawbar 6 but in many applications it is not necessary for the circle member to move through a full rotation. The position of the hydraulic cylinders and their securement to the drawbar can take this into account.

Once the circle member has been rotated to the desired position fluid to the hydraulic cylinders can be blocked. In this way each of the hydraulic cylinders acts as a lock against further movement of the circle member. This provides positive hydraulic locking of the circle member to the drawbar. The cylinders and their securement to the circle member and the drawbar can be designed to reduce wear. The various pivot points can be protected from the environment and are less prone to wear than the gear arrangement of the prior art. Furthermore, substantial savings in the manufacturing cost can be realized as the cost of cutting and heat treating the "circle gear" is eliminated. Again, the large bearings used to support the circle member beneath the drawbar can also be of a robust design and at least partially protected against the elements.

The embodiments of FIGS. 1 through 4 have the drive cylinders secured to the frame at a generally central position with the opposite ends of the cylinder secured to and rotatable with the circle member.

Figure 5:
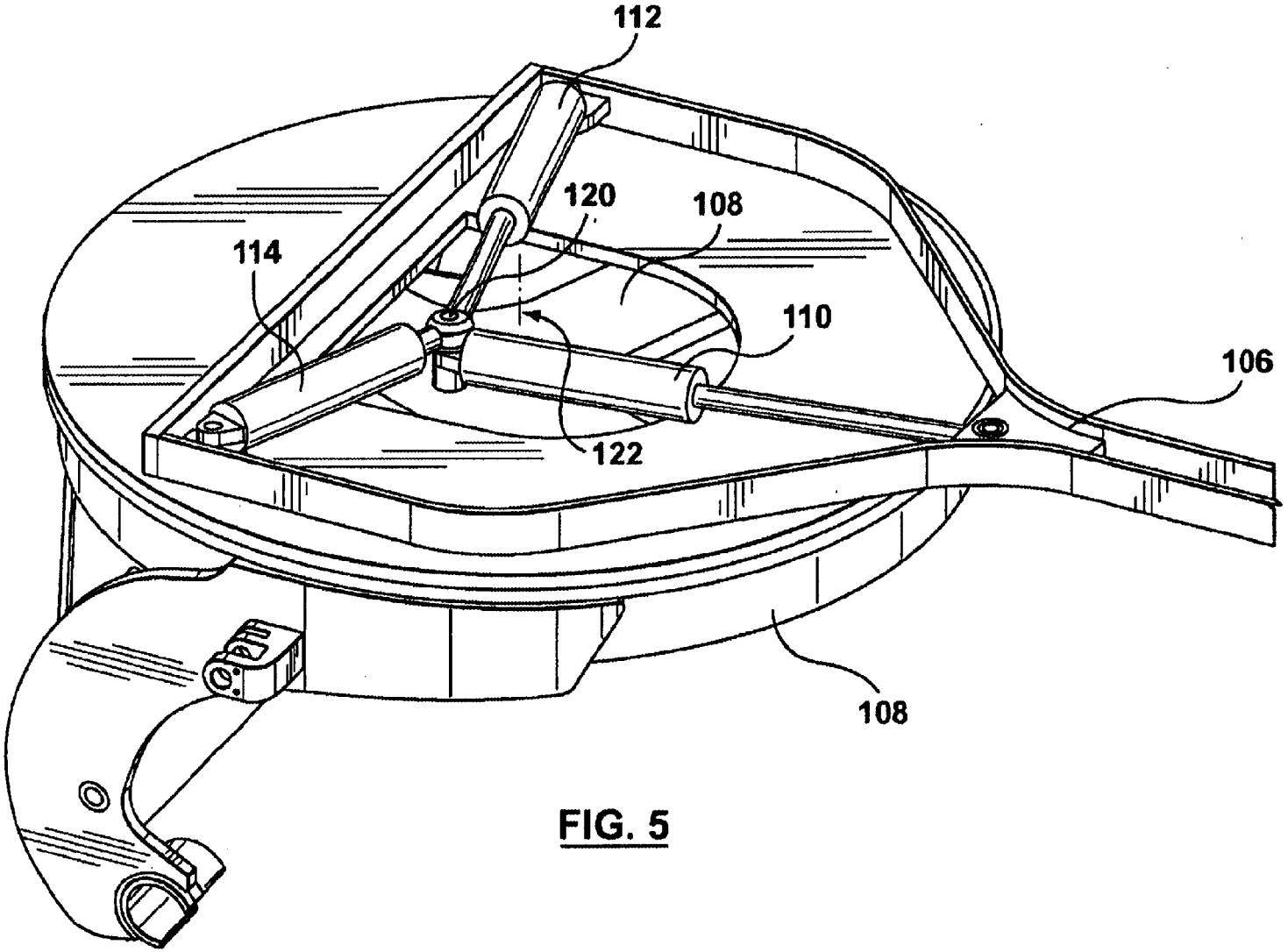
FIG. 5 is a partial perspective view of an alternate embodiment.

The embodiment of FIG. 5 is a reverse configuration where the cylinders 110, 112 and 114 are secured to the drawbar 106 at outwardly spaced positions with the opposite ends of the cylinders secured on shaft 120, forming part of the rotatable member 108. This member generally rotates about axis 122 and as such, shaft 120 is at an offset location. The spacing between shaft 120 and axis 122 defines a crank arm for rotation of the rotatable member 108.

The embodiment of FIG. 5 shows three cylinders, however, for certain higher load applications, four or more cylinders are used. The diameter of the cylinders and the working hydraulic pressure determine the force available for rotation of the rotatable member as well as the force experienced by the cylinders in maintaining the position of the rotatable member during normal operation. This hydraulic drive arrangement also allows additional freedom in design of the drawbar and its cooperation with the rotatable member and work implement.

Figure 2:
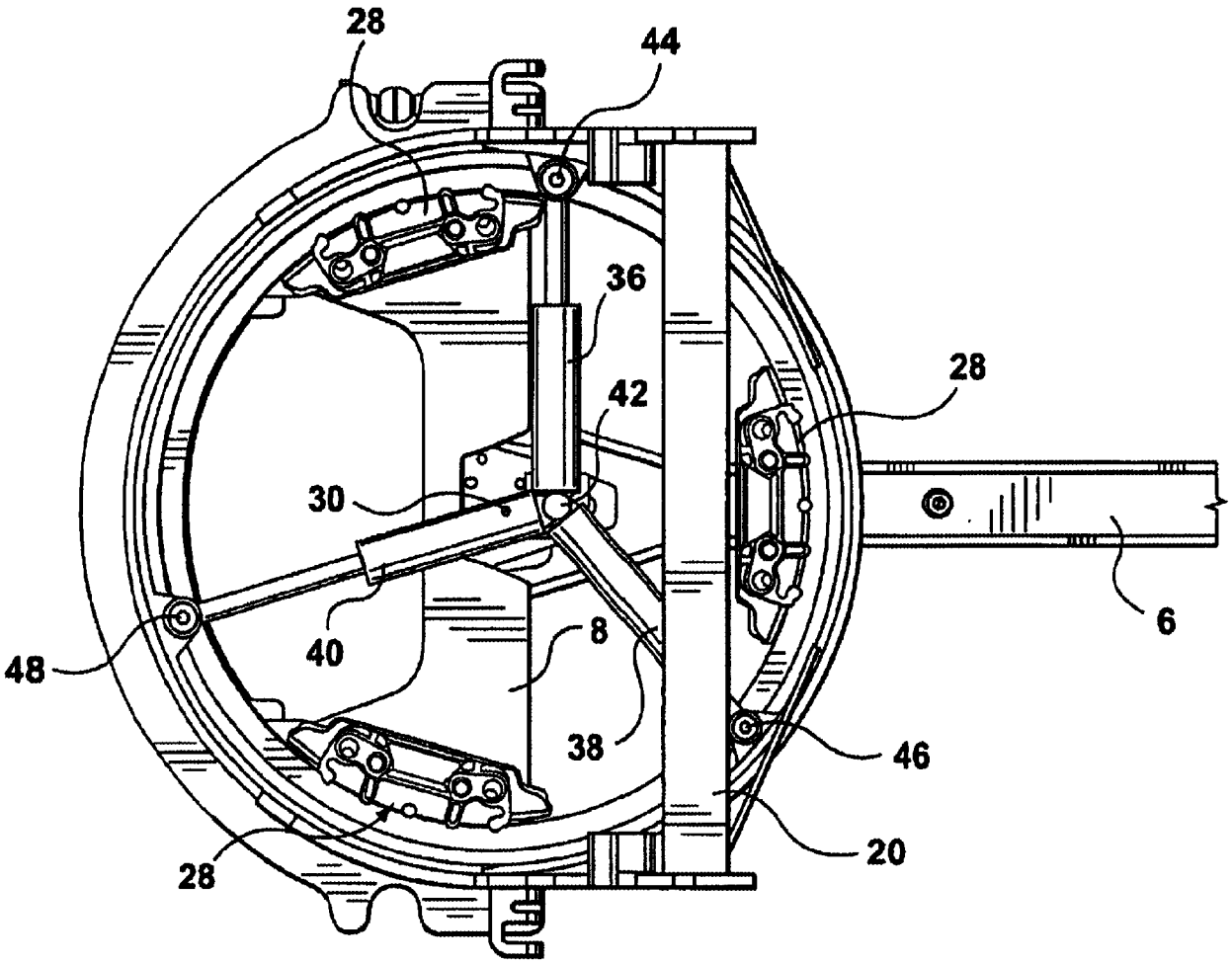
FIG. 2 is a bottom view of the drawbar assembly with the circle member in a neutral position.

FIGS. 6, 7, 8 and 9 show details of one possible configuration of the timing valve for use in controlling the cylinders as shown in FIG. 2. In this case, the timing valve has a stationary pivot pin 80 and the casting 82 rotates about the pivot pin 80. The rotatable casing 82 basically rotates with the cylinders. The timing valve has a first port 62 and a second port 64 for supplying and removing hydraulic fluid from the cylinders. Each of the cylinders is double acting cylinders. Hydraulic fluid under pressure can be introduced into either first port 62 or the second port 64. In this way the direction of rotation of the circle drive can be reversed. The stationary pivot pin 80 is divided by divider 84 with one side of the divider 84 forming a cavity for the port 62 and the other side forming a cavity for the port 64.

The body casting 82 has three pairs of cylinder ports, namely 66 and 68, 70 and 72, and 74 and 76. Each pair controls one of the double acting hydraulic cylinders. These ports are opposite each other and are always positioned on opposite sides of the divider 84. One of the ports will be the supply port to the cylinder and the other port will be the return line from the cylinder. The determination which is the supply in which is the return, is given by which of the ports 62 and 64 is connected to the supply of hydraulic fluid.

Figure 6:
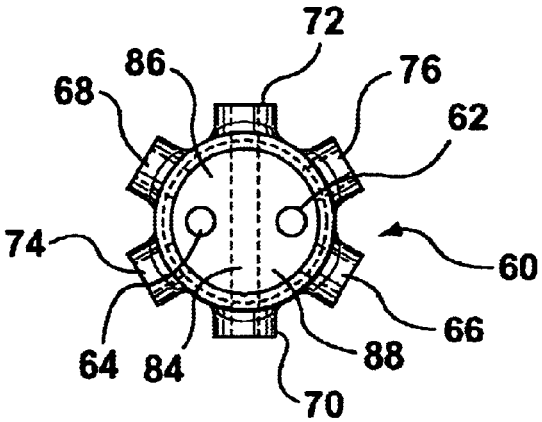
FIG. 6 is a top view of the timing valve.
Figure 7:
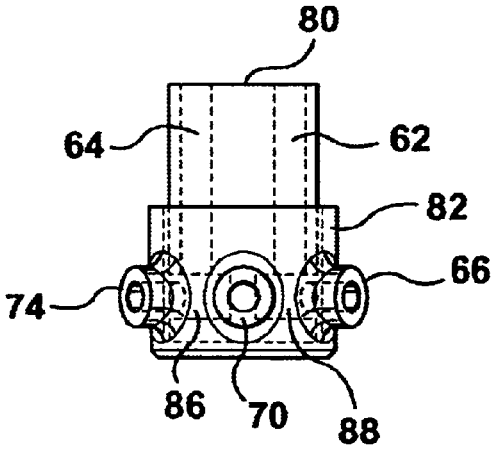
FIG. 7 is a front view of the timing valve.
Figure 8:
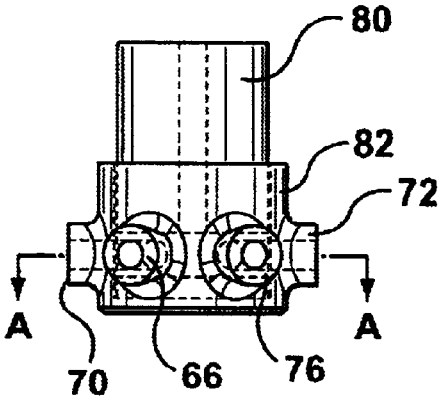
FIG. 8 is a side view of the timing valve.
Figure 9:
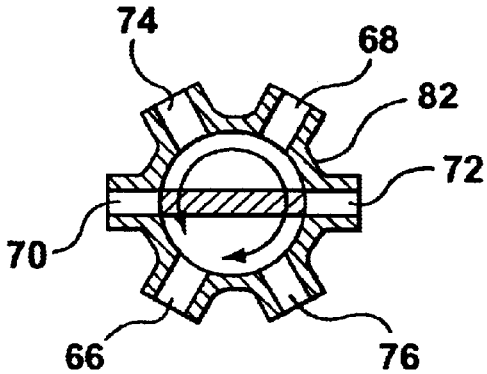
FIG. 9 is a sectional view along line A—A of FIG. 8.

With the pivot pin as shown in FIG. 6, ports 66 and 68 are operative as well as ports 74 and 76. The partition member 84 has basically shut off port 70 and 72. As can be appreciated, as the circle drive rotates, certain of these cylinders is more effective while others are essentially not operating or operating to a lesser extent. The cylinders must also change from an extending mode to a retracting mode. This is accomplished by the partition member moving past the particular ports to reverse the operation.

The timing valve shown is designed for use up to three cylinders appropriately spaced about the circle drive, however, the principle is applicable for controlling of four cylinders. For four cylinders, the position of the pairs of ports changes and a further pair of cylinder ports are provided for the additional cylinder.

Other arrangements for controlling of the cylinders can be used, however, the above timing valve has proven relatively inexpensive to produce and reliable.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A circle drawbar assembly for a motorgrader comprising a drawbar frame, a circle member mounted on said frame for rotation about a circle axis, a drive arrangement secured to said frame and connected to said circle member for rotation thereof about said circle axis, said drive arrangement comprising a plurality of hydraulic cylinders connected to said circle member at spaced positions and each hydraulic cylinder being pivotally connected to said frame at a position adjacent to but offset from said circle axis, and a control arrangement for extending and retracting said cylinders in timed relationship to rotate said circle member about said circle axis.

2. A circle drawbar assembly as claimed in claim 1 wherein said control arrangement is a timing valve.

3. A circle drawbar assembly as claimed in claim 2 wherein said timing valve includes an input signal corresponding to the rotary position of said circle member.

4. A circle drawbar assembly as claimed in claim 2 wherein said timing valve includes a mechanical input signal associated with the rotary position of said circle member relative to said drawbar frame used to control said hydraulic cylinders.

5. A circle drawbar assembly as claimed in claim 1 wherein said plurality of hydraulic cylinders is at least 3 cylinders.

6. A circle drawbar as claimed in claim 1 wherein said hydraulic cylinders are secured to said drawbar frame at a common position.

7. A circle drawbar assembly as claimed in claim 5 said cylinders are each attached to said drawbar frame at a common position.

8. A circle drawbar assembly as claimed in claim 7 wherein said cylinders are attached to said circle member to define a similar angular spacing between adjacent cylinders.

9. A circle drawbar assembly as claimed in claim 8 wherein said drawbar frame has at least three bearings which engage an inwardly extending flange of said circle member.

10. A circle drawbar assembly as claimed in claim 8 wherein said hydraulic cylinders also function to maintain the position of said circle member locked when the cylinders are not being used to rotate said circle member.

11. A circle drawbar assembly as claimed in claim 9 wherein said circle member includes at an outer edge thereof a downwardly extending circle flange connected to said inwardly extending flange and being concentric therewith.

12. A circle drawbar assembly as claimed in claim 11 including at least 3 bearings which engage said circle flange and said inwardly extending flange to rotatably secure said circle member to said drawbar frame.

13. A circle drawbar assembly as claimed in claim 12 wherein interior and exterior edges of said inwardly extending flange are of a non gear tooth configuration.

14. A circle drawbar assembly as claimed in claim 1 wherein said hydraulic cylinders are double acting hydraulic cylinders and all secured about a common shaft offset.

15. A drawbar assembly for a motorgrader comprising a drawbar frame, a rotatable member mounted on said frame for rotation about a generally vertical axis, a drive arrangement secured to said frame and connected to said rotatable member for rotation thereof about said vertical axis, said drive arrangement comprising a plurality of hydraulic cylinders with one end of each cylinder pivotally acting on a common shaft extending from said rotatable member and with an opposite end of each cylinder secured to said frame, said cylinders applying a rotational force to said rotatable member by the timed extension and retraction of said cylinders, said cylinders being disposed at different orientations to said drawbar frame, a control arrangement for extending and retracting said cylinders in timed relationship with each other and the position of said rotatable member to adjust the rotational position of said circle member relative to said drawbar frame.

16. A drawbar assembly as claimed in claim 15 wherein each cylinder has said one end secured to said drawbar frame at spaced outward positions and extend inwardly with said second ends secured to said circle member at an offset position adjacent said vertical axis.

17. A drawbar assembly as claimed in claim 16 wherein said rotatable member is a circle member.

18. A drawbar assembly as claimed in claim 10 wherein said plurality of cylinders is at least 3 cylinders.

19. A drawbar assembly as claimed in claim 16 wherein said cylinders are at least 3 cylinders and said cylinders are pivotally secured to said rotatable member about a common point offset from said vertical axis to define a fixed length crank arm for rotation of said rotatable member.

* * * * *